United States Patent [19]

Lunardi et al.

[11] Patent Number: 4,484,674

[45] Date of Patent: Nov. 27, 1984

[54] GUIDING APPARATUS FOR THE TRAVEL ELEMENTS OF ENDLESS CONVEYORS, SUCH AS ESCALATORS AND THE LIKE

[75] Inventors: Gerhard Lunardi; Gerhard Wipp, both of Vienna, Austria

[73] Assignee: Inventio AG, Hergiswil, Switzerland

[21] Appl. No.: 325,929

[22] Filed: Nov. 30, 1981

[30] Foreign Application Priority Data

Dec. 23, 1980 [CH] Switzerland ..... 9514/80

[51] Int. Cl.[3] ..... B66B 9/12

[52] U.S. Cl. ..... 198/332; 198/861; 403/13

[58] Field of Search ..... 198/326, 332, 335, 337, 198/861; 403/13, 14; 104/94, 117, 107, 109

[56] References Cited

U.S. PATENT DOCUMENTS

| | | | |
|---|---|---|---|
| 1,956,155 | 4/1934 | Lindquist et al. | 198/335 |
| 1,958,162 | 5/1934 | Diehl | 104/109 |
| 2,686,585 | 8/1954 | Marples et al. | 198/332 |
| 3,707,220 | 12/1972 | Boltrek et al. | 198/332 |
| 3,834,513 | 9/1974 | Miura et al. | 198/332 |
| 4,046,248 | 9/1977 | Goffredo et al. | 198/861 |

FOREIGN PATENT DOCUMENTS 2157423 5/1972 Fed. Rep. of Germany .

*Primary Examiner*—Robert J. Spar
*Assistant Examiner*—Jonathan D. Holmes
*Attorney, Agent, or Firm*—Werner W. Kleeman

[57] ABSTRACT

The guiding apparatus comprises substantially rectangular rail holders and L-shaped rail holders. Main and follower travel rails or tracks are supported by such rail holders and there are provided side plates at which there are mounted the rail holders, the side plates being supported upon a carrier frame. These rail holders are provided at their attachment or fastening side with at least two respective centering protuberances or nubs or the like which engage into corresponding centering openings provided in the side plates to which the rail holders are fastened. The rail holders possess, at their rail contact side, a dovetail clamping device which, in cooperation with a dovetail profile or section extending along the underside of the travel rail or track, to reliably and easily releasably holds the travel rails and the rail holders by virtue of a clamping action which is exerted at all sides of the dovetail profile. The side plates, and, in particular, the position of their centering openings are produced true or exact to size and with narrow tolerances so that in cooperation with the related centering protuberances and the rigid dovetail clamping there is automatically ensured parallelism and alignment of the travel rails or tracks required for a quiet escalator or stair running. The guiding apparatus can be assembled without the need to resort to assembly fixtures or jigs and without subsequent adjustment from individual mass-produced parts.

7 Claims, 4 Drawing Figures

GUIDING APPARATUS FOR THE TRAVEL ELEMENTS OF ENDLESS CONVEYORS, SUCH AS ESCALATORS AND THE LIKE

BACKGROUND OF THE INVENTION

The present invention relates broadly to transportation systems and, in particular, concerns a new and improved construction of guiding or guide apparatus for the travel elements of endless conveyors, such as escalators and the like, wherein main and follower rails are secured to a support or carrier frame by means of rail or track holders.

With such type of guide equipment the travel elements are supported and guided along an endless path of travel or track, and there is intended to obtain travel of such travel elements with as little noise and vibrations as possible. In the environment of escalators the guide apparatuses also serve the purpose of horizontally guiding the tread or walk surface of the travel or running elements constructed as stair steps during passage of the upper run both in horizontal direction as well as at the ascending region and at the transition locations.

German Patent Publication No. 2,157,423 discloses an escalator construction of the aforementioned type. More specifically, with this prior art system there are used special precision templets for the exact setting or adjustment of the travel or track rails. These precision templets contain alignment holes and by virtue of an appropriate machining process assure for parallelism and alignment of the travel rails or tracks with sufficient accuracy. For the assembly, the rail elements are held in a rigid or fixed mutual correlation by means of the templets and are connected with the same by performing precision welding.

Such assembly or erection procedures are complicated and afflicted with the known drawbacks which prevail when employing welding techniques: firstly, an appreciable expenditure in both equipment and work is needed for the welding together of the guide system in an accurate fashion, so that such assembly work cannot be considered to be capable of being performed rapidly and economically. Additionally, notwithstanding this appreciable effort it is impossible to guarantee for synchronous running of the travel elements to the required degree. This is so because even when performing precision welding distortions in the structure arise because of the introduction of heat or thermal energy during the welding process. This distortion can only be eliminated in part by subsequent cold and hot straightening.

Furthermore, with such assembly or erection concept it is necessary to use structural elements of the most different design and dimensions which are related to the system which is being erected. The employment of individual parts which have been fabricated in large series or mass-produced, which can be used for a wide range of installations in the form of similar type standardized parts generally is not possible.

Moreover, when the erection and assembly work is carried out by welding the travel rails or tracks which have become worn generally are difficult to dismantle, or, in fact, are connected in a non-releasable fashion with the support or carrier frame. Hence, there is not present any possibility of subjecting these worn tracks or travel rails, independent of the carrier frame, to a surface treatment or, whenever such travel rails have experienced excessive wear to rapidly and easily exchange the same.

SUMMARY OF THE INVENTION

Therefore, with the foregoing in mind it is a primary object of the present invention to eliminate the previously described drawbacks and limitations of the prior art constructions.

Another and more specific object of the present invention aims at providing a new and improved construction of guiding apparatus for endless conveyors or transport systems, such as escalators and the like, which can be assembled with very little effort and without having to resort to the use of assembly equipment at the erection site and the assembly work nonetheless is exceptionally accurate.

Yet a further significant object of the present invention and in keeping with the immediately preceding object of the invention is to devise a guiding apparatus for the travel or track rails of a conveyor system, wherein these track rails can be easily dismantled and replaced whenever the need arises.

Still a further significant object of the present invention aims at providing a new and improved construction of a guiding apparatus which can be assembled from very few standardized parts which may be manufactured in large series or mass-produced, and wherein it is thus possible to simplify the storage of such parts as well as rendering less expensive the actual manufacturing costs thereof.

A further important object of the present invention is directed to a new and improved construction of guiding apparatus for the track elements or rails of transport systems, which guiding apparatus is relatively simple in construction and design, extremely economical to manufacture, not readily subject to breakdown or malfunction, easy to assemble and disassemble particularly as concerns the track elements or rails supported by such guiding apparatus.

Now in order to implement these and still further objects of the invention, which will become more readily apparent as the description proceeds, the guiding apparatus of the present development is manifested by the features that the rail holders supporting the main and follower rails or tracks, also sometimes referred to as the load-bearing rails and the guide rails, respectively, are provided at their attachment side equipped with at least one attachment or fastening hole for receiving an attachment element with at least two centering protuberances or nubs engaging in appropriately configured or complimentary centering openings of a side plate or shield attached at the support frame. Moreover, each such rail holder is provided at its rail or track contact side which is disposed at right angles to its attachment side with a dovetail clamping device. This clamping device serves to receive the rail or track underside which in profile or sectional shape has a dovetail configuration. The dovetail clamping device comprises a fixed clamping jaw arranged at the rail holder and a releasably secured or detachable clamping jaw which can be fastened at the related rail or track holder.

According to a preferred constructional manifestation of the invention the centering protuberances or the like and the attachment hole at the rail holder are arranged in mirror-image symmetrical orientation with respect to the rail-holder central plane which is disposed perpendicular to the attachment side and rail contact or support side.

In order to facilitate the attachment of the travel rails or tracks which are of curved configuration at the transition or turning regions, a further aspect of the invention contemplates bevelling the rail supports at the dovetail clamping devices at the region of the run-up and run-off of the travel rails or tracks.

Additionally, to ensure for an economically favorable manufacture of the guiding apparatus it is proposed to fabricate the rail holders by die casting techniques and to form the centering protuberances or nubs in the form of exact-to-size sprues or the like.

According to a further preferred construction of the invention the rail holder possesses a substantially rectangular or L-shaped sectional area or cross-section at the central plane of the rail holder.

Additionally, the L-shaped rail holder is equipped with a finger-like prologation or extension, in order to clamp the counter-guides between its longitudinal side and the side plate or shield.

By virtue of these measures there not only can be advantageously solved the objects of the invention, but additionally there is realized a guiding or guide apparatus affording the following significant advantages:

The guiding apparatus is fabricated with the alignment of all of the critical individual parts such as to ensure for an optimum positioning and attachment of the travel tracks or rails, so that the erection can be accomplished with very little effort and without having to resort to assembly equipment or jigs. Thus, there is neither required the erection of an expensive assembly frame nor a great amount of space for the storage of the components or parts.

A further significant advantage of the invention resides in the fact that for the accuracy of the guiding of the steps or the like, and thus, for assuring for quiet travel of an escalator, it is only necessary to make certain that there is an exact plug connection between the centering protuberances and the related centering opening and that during their production narrow tolerances are maintained. However, this can be easily realized and in a cost-favorable fashion, since the fabrication of the individual structural parts can be accomplished at the factory where there are available better automatically operating machines than at the erection site. In this regard it is advantageous to employ a numerically controlled machine for the machining of the side plates and, in particular, for the formation of the centering openings. In this way it is possible to assure with sufficient accuracy all of the essential influencing factors which determine the running or operation of an escalator.

Since the synchronism of the travel elements needed for quiet running of the escalator is sufficiently ensured for by virtue of the coaction of the centering protuberances and centering holes or openings, it is no longer necessary to align the travel rails after they have been installed and to adjust their dimensions. Therefore, it is beneficially possible to dispense with the need for any adjustability of connections within a rail block.

By reason of the jigless and simple assembly, without the need for any subsequent adjustment of the travel rails or tracks, the inventive guide or guiding apparatus is exceptionally suitable for being erected at the site where work frequently has to be performed under difficult conditions because of constructional or other difficulties. Possible inadequacies in the performance of the work cannot have the same detrimental effect upon the synchronism of the travel elements, since the accuracy of the step guidance is governed by the prefabricated individual parts which are manufactured within narrow tolerances or limits.

Additionally, the modular-like assembly elements are constructed according to the invention such that they can be easily assembled at the erection site and also again easily dismantled and possess a relatively modest weight. Thus, for instance, the travel rails or tracks which have been exposed to wear can be easily dismantled and again assembled without having to resort to the use of jigs or assembly equipment for this purpose, in order to thus service and repair or replace such worn tracks by simply rendering ineffectual or releasing the dovetail clamping action.

By virtue of the easy exchangeability of the parts or components the maintenance and servicing of endless conveyor systems, such as escalators, is markedly simplified as is also the needed training of the maintenance or servicing personnel.

The essential elements of the inventive erection concept for the transport system, namely the erection concept for the rail holders, the counter-guides, the rivet and screw or threaded bolt connections as well as the dovetail clamping device are related to the function and not the installation. Thus, they are always useable repeatedly in the same construction or design, independently of any given system or installation. The accommodation to the individual fields of application is accomplished by means of the side plates or shields and by the positioning of the corresponding centering openings or holes.

As concerns the construction elements, such as the connection technique, it is therefore possible to speak in terms of a modular-type construction. For a large number of variations of installations, such as for instance for the standard widths of 80 centimeters and 110 centimeters it is possible to use the same individual parts or components which have been fabricated in standard sizes according to mass production or series-fabrication techniques. These individual parts distinguish themselves, among other things, by the ease with which they can be handled and their wide possibilities of use.

By virtue of the foregoing there is attained the benefit that there can be accomplished a simple fabrication and an uncomplicated disposition of the material requirements.

This, in turn, results in an appreciable savings in cost and savings in space at the erection site, because the work which has to be performed at the erection site is simplified and there is neither needed the erection of an expensive assembly frame nor is there required a great deal of space for the storage of the parts or components.

It should be evident that the improvements which can be realized when practising the invention, such as the jigless assembly, the modular-like construction and design, the easy exchangeability of the travel rails or tracks and so forth, also affords economic advantages:

The fabrication of the escalators is rendered less expensive, the costs for the assembly and maintenance thereof is appreciably lowered, and generally there is thus realized a cost-favorable solution.

Although the invention will be described in greater detail hereinafter in conjuction with an escalator, the underlying principles are equally applicable in the same manner also for other guide or guiding devices.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
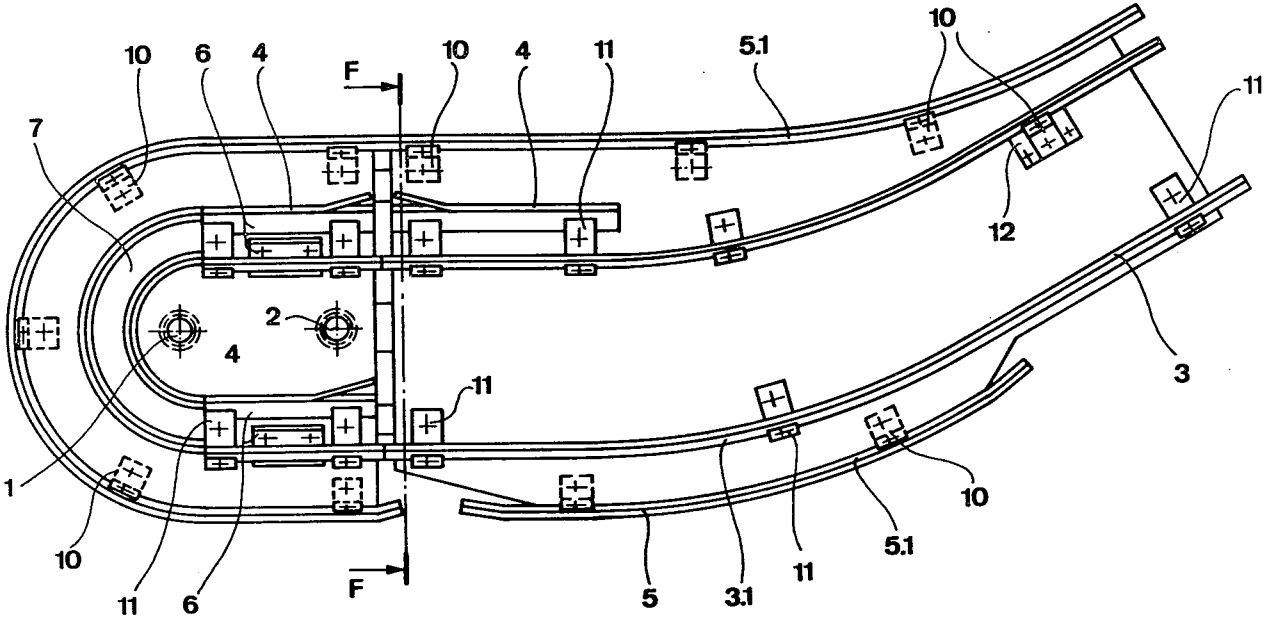
FIG. 1 is a vertical sectional view of a lower rail or track block forming the lower closure or termination of an escalator, the section being taken substantially along the line H—H of FIG. 2.

Describing now the drawings, it is to understood that only enough of the construction of the transport system or conveyor device, here assumed to be an escalator, has been shown in order to enable those skilled in the art to readily understand the underlying principles and concepts of the present development, while simplifying the showing of the drawings. In FIG. 1 there has been specifically illustrated a preferred embodiment of guiding or guide apparatus in conjunction with the lower escalator or staircase end, and serving to demonstrate how the step-shaped platforms or steps can be brought out of their inclined path into an essentially horizontal path or vice versa and reverse their direction of movement. The following description and considerations are analogously applicable equally also for the inclined path of the escalator and the upper escalator end, both of which have not here been specifically shown for the stated reason.

Continuous escalators are generally driven by an upper chain or sprocket wheel or gear seated upon a motor-driven primary shaft. Such escalators consist of a multiplicity of step-like platforms which are hingedly connected with one another at both sides. At the lower escalator end the chain travels about idler chain wheels 1 and 2 which frequently are subjected to the action of a tensioning spring in order to maintain the chain tension, and this is well known to the expert skilled in the art of escalators.

In order to support and guide the platforms along their endless path of travel there is provided for the upper load-carrying run and also for the lower returning run a respective rail system. Both rail systems possess at the side of the stairs or platforms main or primary rails 3 for the chain rollers, and at the region of the reversal stations or locations there are provided counter-guides 4. As far as the follower or guide rolls are concerned there are provided follower or guide rails 5 which, however, at the lower run only extend past the escalator ends. Between the inclined regions or paths and the horizontal regions or paths the main rails or tracks 3.1 and the follower rails or tracks 5.1 are of curved configuration, in order to afford the here required step transition. Additionally, at this region there continuously changes at the upper run the spacing between the curved primary or main rails 3.1 and the follower or guide rails 5.1, in order to ensure for the gradual transition from the platform configuration into the step-like configuration or vice versa depending upon the direction of travel of the steps.

At the lower and also at the, here not particularly illustrated, upper escalator or stair end, where the stair steps reverse their direction of movement, the main rails are constructed as channel-shaped guides 6 having semicircular shaped end parts 7.

By virtue of the inventive guiding apparatus, which will be explained in greater detail in conjunction with FIGS. 2 and 3, the travel rails or tracks 3 and 5 in their different constructions are assembled free of jigs or assembly equipment with the carrier frame 21 by rail or track holders 10 and 11 and additional constructional or build-up elements. Because of the provision of the individual parts or components which have been fabricated with very narrow tolerances there is automatically ensured for the parallelism and the alignment of the travel rails or tracks. For the appropriate vertical and horizontal positioning of the travel rails or tracks there are, however, required two constructions of the rail or track holder, and, specifically a substantially rectangular rail or track holder 10 and a substantially L-shaped rail or track holder 11. The track or rail holders 10 and 11, as a part of the guide apparatus, thus function as central connection elements between the carrier or support frame and the travel rails or tracks.

Figure 3A:
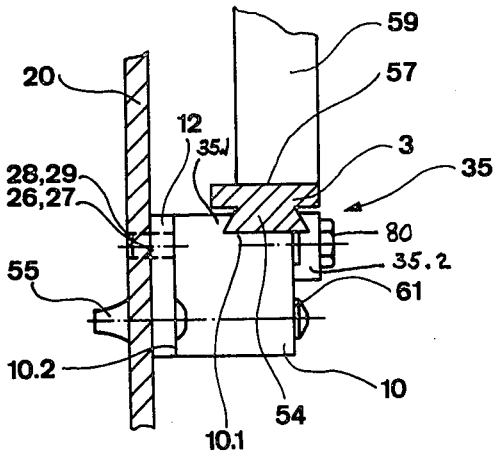
FIG. 3*a* illustrates in vertical section a construction or structure unit composed of a substantially rectangular rail or track holder having fixedly clamped thereat a related travel rail or track and which is mounted at a side plate or shield.

The width difference resulting from the approach of the primary and follower rails at the region of the upper run and arising between the related rail holders can be compensated through the provision of intermediate elements 12, for instance formed of sheet metal although other constructions are conceivable, and is best seen by referring to FIG. 3*a*.

Figure 2:
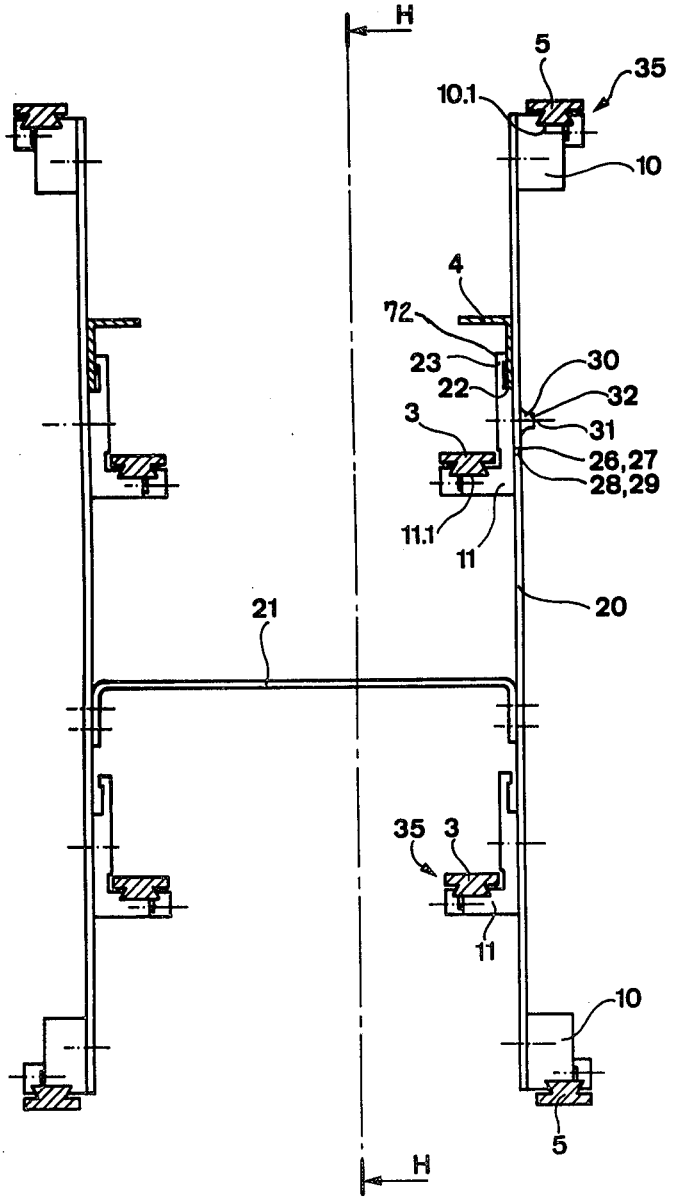
FIG. 2 is a vertical sectional view of the lower rail block forming the lower closure or termination of an escalator, the section being taken substantially along the line F—F of FIG. 1, and because of the symmetry of the construction only the right-hand half of the vertical section being designated by reference characters.

FIG. 2 schematically illustrates the inventive build-up or structural concept of the guiding apparatus in conjunction with the lower rail block. Because of the symmetry of the construction, and as already mentioned previously, only the right-hand half of the sectional view of FIG. 2 has had specifically applied thereto reference characters. It is to be understood that while the description refers to the right-hand portion of FIG. 2 the comments are equally applicable for the left-hand portion of this sectional showing.

For the jigless build-up or assembly of the lower rail block it is initially necessary to bolt the side plates or shields 20 to the separately machined, substantially U-shaped transverse carriers or supports 21 defining a supporting or carrier frame. Then, the centering protuberances 26 and 27 at the rail or track holders 10 and 11 are placed into the corresponding centering holes or openings 28 and 29 at the side plates 20 and, in this way, the rail holders 10 and 11 and the side plate 20 are fixed in their mutual position and connected with one another by inserting any suitable fastening means 30 into the attachment hole or opening 31. The tightening rivet 32 which is here used, by way of example, can be replaced by a threaded bolt or screw or any other detachable or non-detachable connecting means.

As part of the guiding apparatus or equipment according to the invention the guide plates or shields 20 fulfill a dual function, namely they serve as precision templets during the assembly work and as supporting elements for the rail holders.

The build-up or assembly concept, constituting an essential feature of the present development, will now be explained in detail with reference to FIGS. 3*a* and 3*b*.

It will be recognized that each of the rail or track holders 10 and 11 possess at their rail or track support or contact sides 10.1 and 11.1, respectively, a related dovetail clamping device 35 serving for the firm clamping of the related travel rails or tracks 3 and 5 at all sides.

During the guiding of the rails or tracks 3 and 5 over the full length of an escalator there appear at the individual regions and also at the upper and lower runs differences in the vertical spacing between the rails and the carrier frame which must be bridged. A first coarse compensation is accomplished by the selection of the rail holder, depending upon whether it is used in the rectangular-shaped or the L-shaped version. Both of these versions namely differ also in the spacing between the lengthwise axis of the attachment or fastening hole and the rail support or contact surface, and the corresponding value 5 centimeters is applicable for the rectangular-shaped rail holder 10 and 10 centimeters for the substantially L-shaped rail holder 11. Any possibly still remaining residual distance can be compensated in a fine manner by appropriately positioning the rail holder at the related side plate. The rectangular-shaped rail holder 10 and the L-shaped rail holder 11 will be explained in greater detail as to their construction in conjunction with FIGS. 3*a* and 3*b*.

The principle of the jigless assembly or erection is faithfully carried out during the attachment of the drawn counterguides 4. These counter-guides 4 are inserted into the related rail holder 11 until they come into contact at location 22 with the rail holder 11 and specifically at the region of the base of a finger-shaped extension or projection 23 thereof and are then clamped against the related side plate or shield 20. To prevent unintentional removal of the counter-guide 4 it is provided with a recess 70 into which engages a protuberance 72 provided at the rail holder 11 (FIGS. 2 and 3*b*). FIG. 3*a* illustrates in detail the assembly of a substantially rectangular-shaped rail or track holder 10, side plate or shield 20 and travel rail or track 3, whereas FIG. 3*b* illustrates the assembly of these components when using a substantially L-shaped rail holder 11. The description given hereinafter as to the connection is analogously applicable for both types of rail holders 10 and 11.

Both the substantially rectangular-shaped rail holder 10 and also the substantially L-shaped rail holder 11 are provided at their attachment or fastening side 10.2 and 11.2, respectively, with two respective centering protuberances or nubs 26 and 27 and at the rail contact side 10.1 and 11.1 of these rail holders 10 and 11, respectively, there is provided a related dovetail clamping device 35. Each such clamping device 35 contains a fixed or rigid clamping jaw 35.1 arranged at the related rail holder 10 or 11, as the case may be, and a detachable clamping jaw 35.2 which can be secured, by means of the threaded bolt 80 or equivalent fastening expedient at the related rail or track holder 10 and 11. The attachment hole or opening 48 serves to receive a suitable attachment or fastening means for the connection of the rail holder with the side plate or shield 20. In order to obtain a priceworthy fabrication the rail holders 10 and 11 are advantageously produced by die casting techniques so that the centering protuberances or nubs 26 and 27 can be constructed true-to-size or exact in their dimensions and are formed as sprues having the required tolerances.

The side plates 20 are provided at the region of the rail holder or support 10 and 11 with centering openings 28 and 29, serving as reference points and which in coaction with the centering protuberances 26 and 27 at the rail holders 10 and 11 ensure for the parallelism and alignment of the travel rails or tracks 3 and 5.

The main and follower rails 3 and 5 possess a substantially dovetail profile or sectional shape 54 along their underside, in order to be able to be fixedly clamped at the related dovetail clamping device 35.

For the assembly work the centering protuberances 26 and 27 provided at the related rail holders 10 and 11 are brought into engagement with the corresponding centering holes or openings 28 and 29 at the side plate 20, and the entire structure is interconnected by a rivet connection 55 or equivalent fastening expedients. The tensioning rivet 55 has been selected for reasons of cost, but however it is to be expressly understood and should be obvious that this exemplary fastening technique imposes no limitations upon the invention. Obviously, it would be possible to connect these parts with a threaded bolt or screw or with any other suitable attachment means.

By virtue of the extremely precise arrangement of the centering openings 28 and 29 at the side plates 20 as well as the centering protuberances 26 and 27 at the rail holders 10 and 11 the latter are automatically positioned such that the travel rails or tracks 3 and 5 which are rigidly connected with the rail holders by means of the described related clamping arrangement or device 35 satisfy all of the requirements as concerns their parallelism and alignment to ensure for quiet running of the escalator.

In coaction with the centering holes or openings 28 and 29 the centering protuberances 26 and 27 not only ensure for the exact positioning of the rail holders 1O and 11 at the related side plate 20, but further they essentially absorb the arising thrust forces. The rivet or bolt connection 55 or the like only serves the purpose of taking-up the traction forces resulting from the torque.

By virtue of the dovetail-shaped clamping device 35 the main and follower rails or tracks 3 and 5, and upon whose travel or track surfaces there move the chain and drag rolls 58 and 59, are secured at all other sides in a rigid fashion to the related rail or track holders 10 and 11.

The dovetail profile or sectional shape 54, appearing at the underside of the related travel or track rail 3 and 5 and extending over the entire length thereof, serves in an ideal fashion, by clamping the travel rails 3 and 5 to fixedly retain, however also releasably, such travel rails at the related rail holders 10 and 11. The dovetail-shaped configuration or profile of the travel rails or tracks 3 and 5, with sufficient area moment of inertia, ensures for a positive track attachment, which also possesses the requisite parallelism and alignment of the travel rails or tracks even when heavily loading the escalator.

Figure 3B:
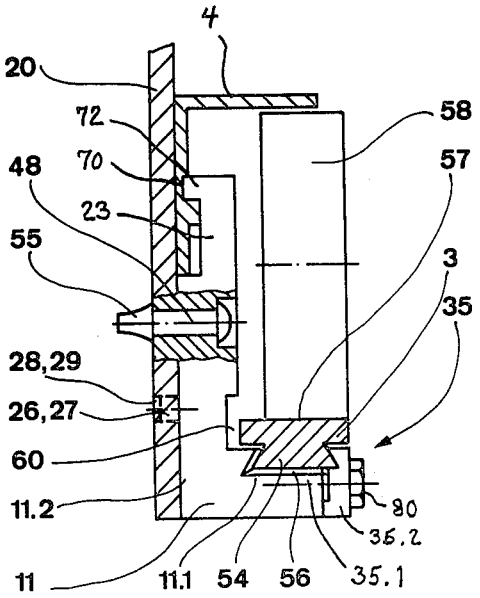
FIG. 3*b* illustrates a constructional or structure unit in vertical section composed of a substantially L-shaped rail holder with a travel rail or track fixedly clamped thereat and which is mounted at a related side plate or shield.

In order to avoid a double fit in the dovetail clamping device 35, an adequate play, as generally indicated by reference character 60 in FIG. 3*b* is maintained between the travel rail or track 3 and the rail holder 11.

Likewise, bevels or bevelled portions 56 are provided at the rail run-up and run-off regions, in order to facilitate reception of the travel rails or tracks which have been bent at the transition region between the horizontal part and the inclined part of the escalator system.

A raised portion 61 (FIG. 3*a*) is necessary if there is to be used as the connection means a force-transmitting rivet 55. By means of this raised portion the span width of the connection, which is governed by the side plate and the rail holder, should be accomodated to the employed force-transmitting rivet, since it is only obtainable commercially in stepped lengths.

The width difference from the lower rail holder to the upper rail holder, arising at the region of approachment of the main and follower rails, can be spanned by the intermediate elements 12. By virtue of these measures it is possible to satisfy all of the requirements imposed during the construction of the escalator with only two types of rail holders, namely a rectangular rail holder 10 and an L-shaped rail holder 11.

While there are shown and described present preferred embodiments of the invention, it is to be distinctly understood that the invention is not limited thereto, but may be otherwise variously embodied and practiced within the scope of the following claims.

Accordingly, What we claimed is:

1. A guiding apparatus for the travel elements of endless conveyor, such as escalators and the like, comprising:

main rails;

follower rails;

means providing a carrier frame;

at least one side plate attached to the carrier frame;

rail holders for securing the main rails and follower fails to the side plate;

said side plate having at least two centering holes;

said rail holders supporting said main rails and follower rails and each rail holder having an attachment side provided with at least one attachment hole for receiving attachment means;

said attachment side of each of said rail holders being provided with centering protuberances engaging in related ones of said centering holes of the side plate;

each of said rail holders having a rail contact side disposed approximately perpendicular to the attachment side of such rail holder;

each said rail holder being provided at the region of its rail contact side with a dovetail clamping device;

said dovetail clamping device serving to receive an underside of the rail supported by said rail holder and which underside possesses a substantially dovetail-shaped profile;

said dovetail clamping device comprising a fixed clamping jaw arranged at the rail holder and a detachable clamping jaw which can be releasably secured at such rail holder;

each rail holder being provided at its attachment side with a substantially finger-shaped prolongation and a protuberance means;

a counter-guide having a recess; and said protuberance means of said rail holder engaging into the recess of said counter-guide and clamping the counter-guide between the protuberance means and the related side plate.

2. The guiding apparatus as defined in claim 1, wherein:

said centering protuberances and said attachment hole at the attachment side of the rail holder being arranged in substantially mirror-image symmetrical relationship with respect to a central plane of the rail holder which is disposed perpendicular to the attachment side and the rail contact side.

3. The guiding apparatus as defined in claim 1, wherein:

said rail contact side being bevelled at run-on and run-off regions of the travel rails and at the neighbourhood of the dovetail clamping device.

4. The guiding apparatus as defined in claim 1, wherein:

said rail holders comprise die cast elements whose centering protuberances define essentially true-to-size sprues.

5. The guiding apparatus as defined in claim 1, wherein:

each said rail holder possesses a substantially rectangular cross-sectional configuration at the central plane of such rail holder.

6. The guiding apparatus as defined in claim 1, wherein:

each of said rail holders defines a substantially L-shaped cross-sectional configuration at the central plane of the rail holder.

7. A guiding apparatus for the travel elements of endless conveyors, such as escalators and the like, comprising:

precision prefabricated, standardized main rails;

precision prefabricated, standardized follower rails;

means providing a carrier frame;

at least one precision prefabricated, standardized side plate attached to the carrier frame;

precision prefabricated, standardized rail holders for securing the main rail and follower rails to the side plate;

said side plate having at least two centering holes;

said rail holders supporing said main rails and follower rails and each rail holder having an attachment side provided with at least one attachment hole for receiving attachment means;

said attachment side of each said rail holders being provided with centering protuberances engaging in related ones of said centering holes of the side plate;

each of said rail holders having a rail contact side disposed approximately perpendicular to the attachment side of such rail holder;

each said rail holder being provided at the region of its rail contact side with a dovetail clamping device;

said dovetail clamping device serving to receive an underside of the rail supported by said rail holder and which underside possesses a substantially dovetail-shaped profile;

said dovetail clamping device comprising a fixed clamping jaw arranged at the rail holder and forming a first portion of the dovetail structure and a detachable clamping jaw which can be releasably secured at such rail holder and forms a second portion of the dovetail structure to complete the same in the assembled state of the dovetail clamping device;

said precision prefabricated, standardized rails, rail holders and said at least one side plate forming modules designed to form a readily mountable and dismountable modular assembly forming the guiding apparatus;

each rail holder being provided at its attachment side with a substantially finger-shaped prolongation and a protuberance means;

a counter-guide having a recess; and said protuberance means of said rail holder engaging into the recess of said counter-guide and clamping the counter-guide between the protuberance means and the related side plate.

* * * * *

UNITED STATES PATENT AND TRADEMARK OFFICE

CERTIFICATE OF CORRECTION

PATENT NO. : 4,484,674

DATED : November 27, 1984

INVENTOR(S) : GERHARD LUNARDI et al

It is certified that error appears in the above-identified patent and that said Letters Patent is hereby corrected as shown below:

Column 3, line 17, delete "prologation" and insert --prolongation--

Column 9, line 30 (Claim 1, line 9), delete "fails" and insert --rails--

Column 9, line 38 (Claim 1, line 15), delete "of" (second occurrence)

Column 10, line 28 (Claim 7, line 10), after "main" delete "rail" and insert --rails--

Signed and Sealed this

*Eleventh* Day of *June 1985*

[SEAL]

*Attest:*

DONALD J. QUIGG

*Attesting Officer* *Acting Commissioner of Patents and Trademarks*